United States Patent [19]

Castillo

[11] Patent Number: 4,867,444

[45] Date of Patent: Sep. 19, 1989

[54] GRIP APPARATUS FOR WEIGHTLIFTING BAR

[76] Inventor: David D. Castillo, 3808 S. 12th St., Phoenix, Ariz. 85040

[21] Appl. No.: 255,776

[22] Filed: Oct. 11, 1988

[51] Int. Cl.[4] ..... A63B 13/00

[52] U.S. Cl. ..... 272/123

[58] Field of Search ..... 272/68, 122, 123, 143; 273/84.1

[56] References Cited

U.S. PATENT DOCUMENTS

| | | | |
|---|---|---|---|
| 359,994 | 3/1887 | Brunner | 272/122 |
| 1,229,658 | 6/1917 | Sandow | 272/122 X |
| 1,664,257 | 3/1928 | McCullough . | |
| 2,205,769 | 6/1940 | Sweetland | 273/84.1 X |
| 2,508,567 | 5/1950 | Dymeck | 272/123 |
| 2,722,419 | 11/1955 | Tarapczynski | 272/123 |
| 3,384,370 | 5/1968 | Bailey et al. | 272/123 |
| 4,222,560 | 9/1980 | Hallerman | 272/68 |
| 4,288,073 | 9/1981 | Petrachonis et al. | 272/116 |
| 4,351,526 | 9/1982 | Schwartz | 272/122 |
| 4,712,792 | 12/1987 | Rogall | 272/122 X |

FOREIGN PATENT DOCUMENTS

| | | | |
|---|---|---|---|
| 1112170 | 9/1954 | France | 272/68 |
| 550961 | 8/1941 | United Kingdom | 272/67 |

*Primary Examiner*—Richard J. Apley
*Assistant Examiner*—Robert W. Bahr
*Attorney, Agent, or Firm*—H. Gordon Shields

[57] ABSTRACT

Hand grip apparatus for weightlifting bar includes a pair of double conical elements secured to the bar to compensate for the anatomical bone structure in the wrists to allow the bones of the hand to be substantially aligned with the bones in the forearm while doing press and curl weightlifting exercises.

18 Claims, 2 Drawing Sheets

30
50
70
10
4
60
40
4
20
18
12
14

122
120
126
128

84
50
80
82
51
54
10
86
88
90
92
52
56
58
18

84
80

88
86
90
92
10
60
12
14

82

80
82
10
40
61
60
12
14
10
66
68
88
86
114
112
110

GRIP APPARATUS FOR WEIGHTLIFTING BAR

BACKGROUND OF THE INVENTION

1. Field of the Invention:

This invention relates to weightlifting and, more particularly, to hand grips for weightlifting bars for curl and press exercises.

2. Description of the Prior Art:

U.S. Pat. No. 359,994 (Brunner) discloses calisthenic apparatus which comprise dumb-bells, or actually handles to which weights may be secured. The handles are of a generally hourglass configuration, with a relatively small diameter in the center and outwardly extending diameters from the center outwardly in both directions. The handles terminate in a relatively open or outwardly flaring mouth for the reception of weights.

U.S. Pat. No. 1,229,658 (Sandow) discloses dumb bell apparatus which are actually two halves of a hand grip, with compression springs between the two halves. The apparatus is designed to be held in a user's hand and squeezed for exercising hand, wrist, and forearm muscles. The two halves of the apparatus are configured to receive the user's hand. One half includes ridges and grooves to receive the fingers, and the other half includes depressions to conform to the bottom of a user's hand.

U.S. Pat. No. 1,664,257 (McCullough) discloses different types of golf club grip elements. Different configurations are included, including hand grips having depressions for fingers and thumbs of a user's hand.

U.S. Pat. No. 2,205,769 (Sweetland) discloses an implement handle having several different configurations. The different configurations include finger grip depressions and related designs. One of the configurations is tapered in an elongated, conical configurations. The specification indicates that the handle configurations are applicable for golf clubs, fencing foils, tennis rackets, oars, paddles, fishing rods, other types of sporting implements, for grips on firearms, and for handles of various tools, for firearm grips, grips or handles for various tools, grips for crutches, for bicycle or motorcycle grips, lever handles, and other types of handles or grips.

U.S. Pat. No. 2,508,567 (Dymeck) discloses a curl bar which includes offset portions in the bar itself. The handle extends permanently at an angle and joins the adjacent portions of the bar. The basic idea behind the offset portions of the weightlifting bar is to allow maximum development of the biceps during curls by relieving the strain on the thumbs and wrists.

U.S. Pat. No. 2,722,419 (Terapozynski) discloses a weightlifting bar having angular configurations, including oblique angled portions on the bar adjacent to the weights, and bar portions referred to as transverse grips.

U.S. Pat. No. 3,384,370 (Bailey et al) discloses a pair of rings disposed along the length of a weightlifting bar and spaced apart from each other. Within each ring is a movable bar which can be adjusted within the ring for the most convenient orientation of the user's hand while performing curl weightlifting exercises. The '370 patent indicates that barbell exercises may be performed with greater ease of movement, more flexibility, and less strain on the wrists and elbow joints of the user.

U.S. Pat. No. 4,222,560 (Hallerman) discloses an exerciser and rehabilitative gripping apparatus in which a liquid of relatively viscosity is placed in a conically configured element, with a bellows element above the conical configured element. The conically configured element is designed to be squeezed by a user's hand to force the high viscosity liquid up into the bellows.

U.S. Pat. No. 4,288,073 (Petrachonis et al) discloses another type of exercise bar which includes oblique angled portions adjacent to the weight, similar to that discussed in the '419 patent above. The bar is straight between the oblique angled portions. The oblique angled portions are referred to as short inclined sections in the '073 patent.

U.S. Pat. No. 4,351,526 (Schwartz) discloses a dumb bell with a hand grip that includes finger depressions and a strap which extends over the back of a user's hand.

British Pat. No. 550,961 (Preston) discloses a dumb bell having a rubber grip on the outside. The rubber grip is a generally oval shaped element. The rubber dumb bell includes a hole extending longitudinally through the dumb bell for receiving cores of different weights or different resiliences so that the resistance of the dumb bell may be increased, depending on a particular core inserted into the handle. The hand grip has a different resiliency, and a different thickness, depending on where a user grips the apparatus for different types of resistance during exercising.

French Pat. No. 1,112,170 (Benassy) discloses a hand grip which has a configuration including finger depressions. The hand grip is designed to orient the hand in a proper position for gripping implements, instruments, etc.

None of the above-discussed apparatus, except for the French patents, addresses either the specific problem of the wrist anatomy, and accordingly none suggests a solution to the specific problem. However, except for the discussed patents and the '567 (Dymeck) patent, none are concerned with exercise apparatus for muscular exercise and development. The alignment of the bones of the hand, wrist, and forearm are not a concern in implement handles, golf clubs, tennis rackets, etc. Both the '567 patent and the '370 patent allow the hands to be oriented at an angle to the bones in the forearm without compensating for the real problem, the bone structure in the wrists.

Grip apparatus for weightlifting bars usable for press and for curl exercises includes a conically configured grip disposed about a bar. The grip widens outwardly for presses and inwardly for curls to allow the bones in the hand to be aligned relatively straight with respect to the ulna and radius bones in the forearm when doing press and curl weightlifting exercises.

Due to the bone structure of the wrist, without the extra thickness provided by the conical element, the hands of a weightlifter tend to rotate inwardly so that excess pressure is placed on the radius bone in the forearm and on the muscles of the wrist and the hand. The muscles in the wrist and the hand accordingly tend to become worn out before the arm or shoulder muscles have been sufficiently exercised. In the alternative, a sprain or strain of the wrist may occur.

The conical taper compensates for the bone structure of the wrist to allow the hand to remain aligned to relieve the strain, and prevent possible strain, in order that the muscles of the arm and shoulders may be fully exercised.

SUMMARY OF THE INVENTION

The invention described and claimed herein comprises a pair of conical flexible elements secured to a weightlifting bar and adapted to be gripped by a user of the weightlifting bar, with the conical elements oriented in one way for curls and another way for presses.

Among the objects of the present invention are the following:

To provide new and useful weightlifting apparatus;

To provide new and useful hand grips for a weightlifting bar;

To provide new and useful grips for a weightlifting bar for curl exercises;

To provide new and useful grip apparatus for a weightlifting bar for press exercises;

To provide new and useful grips for a weightlifting bar having a conical configuration; and To provide new and useful double conical hand grip apparatus for a weightlifting bar.

DESCRIPTION OF THE PREFERRED EMBODIMENT

Figures 1, 2, 3, 4, 5, 6, 7, 8:
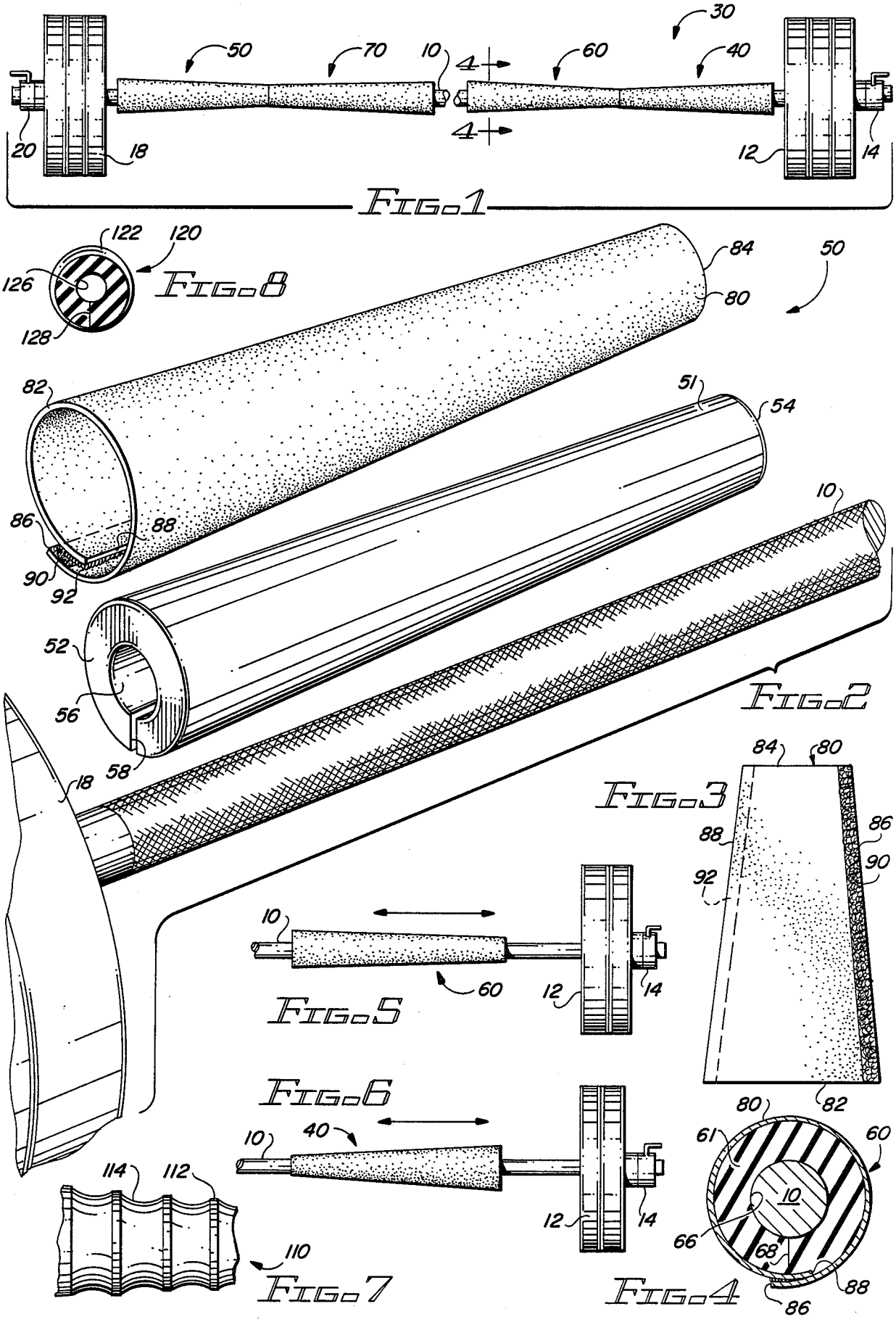
FIG. 1 is a front view of the apparatus of the present invention in its use environment.
FIG. 2 is a perspective view of a portion of a weightlifting bar with a portion of the apparatus of the present invention disposed adjacent to the bar.
FIG. 3 is a plan view of a portion of the apparatus of the present invention.
FIG. 4 is a view in partial section taken generally along line 4—4 of FIG. 1.
FIG. 5 is a front view illustrating the use of the apparatus of the present invention.
FIG. 6 is a front view illustrating the use of another portion of the apparatus of the present invention.
FIG. 7 is a front view of a portion of an alternate embodiment of the apparatus of the present invention.
FIG. 8 is a view in partial section of a portion of another alternate embodiment of the apparatus of the present invention.

FIG. 1 is a front view of a weightlifting bar 10 disposed in a horizontal orientation. The bar 10 is shown broken in the middle to indicate that it may be of any desired length. At opposite ends of the bar are weights 12 and 18. The weights 12 and 18 are secured to the bar by outer collars 14 and 20, respectively. Between the weights 12 and 18, and disposed on the bar 10, is shown a grip apparatus 30. The grip apparatus 30 includes four separate tapered grip elements, including a pair of outer grip elements 40 and 50, and a pair of inner grip elements 60 and 70. The grip elements are substantially identical in that each comprises a relatively elongated tapered conical configuration. The conical elements are in the form of a relatively long and relatively narrow truncated cone. The ends of the cones are substantially perpendicular to the longitudinal axis of the bar 10. If desired, a pair of grips, consisting of an outer and an inner grip, may be secured together. In the alternative, each element may be loose, separate and free from each other grip. The separate grips may be individually placed on and removed from the bar 10, as desired. In case of separate grips, only a single pair is required. When doing from curls to presses, and vice versa, the separate grips are simply reversed. This will be discussed below.

FIG. 2 is an enlarged perspective view of a portion of the bar 10 and the weight 18 disposed on the bar. The tapered grip 50 is shown spaced apart from the bar 10. The tapered grip 50 includes a large diameter end 52 and a small diameter end 54. Within the grip 50 is a longitudinally extending bore 56. The ends 52 and 54 are substantially perpendicular to the bore 56. The diameter of the bore 56 is substantially the same as the outer diameter of the bar 10.

A slot 58 extends radially through the grip 50 and axially along the grip. The purpose of the slot 58 is to allow the grip 50 to be spread apart to be put onto and removed from the bar 10. The slot 58 thus is a convenient way for the grip 50 to be placed on or taken off from the bar. The slot 58 also allows the grip to be moved along the bar, as will be discussed below.

Spaced apart from, but adjacent to, the hand grip 50 in FIG. 2, is a covering 80. The covering 80 is shown in its open configuration in FIG. 3. In FIG. 2, the covering 80 is shown in its curved or folded position, as if it were disposed on the grip 50.

The covering 80 includes a wide diameter end or edge 82 and a narrow diameter end or edge 84. The ends or edges 82 and 84 obviously are paired or mated with the large diameter end 52 and small end diameter 54, respectively, of the grip 50. The covering 80 also includes a pair of relatively long sides, including a side 86 and a side 88. The sides 86 and 88 correspond to the axial length of the grip 50.

On the inside of the covering 80, and disposed adjacent to the side 86, is a strip of "Velcro" type fastener 90. On the outside of the covering 80, and disposed adjacent to the side 88, is a mating or complementary strip of "Velcro" type fastener 92. In FIG. 2, the "Velcro" type fasteners 90 and 92 are shown disposed adjacent to each other. The complementary fasteners 90 and 92 are used to secure the covering 80 to the grip 50. The covering 80 is accordingly configured to closely or tightly engage the grip 50.

The covering 80 is preferably made of relatively soft leather, or a similar, non-slip type of material. Obviously, it is important that the cover remain secured to a grip while the bar 10 and its weights 12 and 18 are being used. The non-skid properties of leather are well known and understood. Thus, leather appears to be a desired material out of which the covering 80 is made. Moreover, the leather allows sweat from a user's hands to be absorbed. If an impermeable material were used for the covering, the sweat from a user's hands would not be able to be absorbed into such material, and a slippery grip would result. A slippery grip may have disastrous effects for a user.

The primary or conical portion of the grip 50 is preferably made of a relatively hard, rubber-type material. It is not solid, but although it is fairly hard, it is somewhat resilient. In FIG. 2, the primary portion comprises a truncated conical element 51. The cover 80 goes over the element 51.

The taper of the grip 50 from one end to the other end allows the grip apparatus to be used by people having different-sized hands. While the diameter of weightlifting bars, such as the bar 10*d*, is relatively standard at about one inch, the size of the hands of individuals, both male and female, may vary widely. Accordingly, the large diameter end of each tapered grip is preferably about two and one-half inches, tapering to about one and one-half inches. The overall length of each grip is preferably about seven or eight inches. The variation in diameter will accommodate most hands.

FIG. 4 is a view in partial section taken generally along line 4—4 of FIG. 1. The bar 10 is shown in cross section, as is the tapered grip 60. The tapered grip 60, and the tapered grips 40, 50, and 70, are all substantially identical. Each tapered grip includes truncated conical elements having a relatively wide diameter end and a relatively narrow diameter end, a central bore extending longitudinally through the conical element, and a longitudinally extending slot which communicates with the bore and extends radially outwardly from the bore to allow each grip to be placed onto the bar 10.

The grip 60 includes a conically tapered element 61, and a longitudinally extending bore 66. The bar 10 is shown in FIG. 4 disposed in the bore 60. The tapered element 61 of the grip 60 also includes a radially extending slot 68. The faces of the slot 68 are shown disposed against each other in FIG. 4 since the grip is fully disposed on the bar.

A covering 80 is shown covering the conical element 61. The longitudinal sides 86 and 88 are shown overlapping each other in FIG. 4 to fasten the cover 80 securely and relatively tightly to the truncated element 61. The "Velcro" type fasteners, as discussed above, are used to secure or to hold the sides of the cover 80 together.

As indicated above, the four grips 40, 50, 60, and 70 are substantially identical to each other. In FIG. 1, the grips 40 and 50 are paired and the grips 60 and 70 are paired. The grips 40 and 50 have their wide diameter ends extending outwardly, adjacent to the weights 12 and 18, respectively. The small diameter ends of the grips 40 and 50 face inwardly, toward the small diameter ends of the grips 60 and 70, respectively. The large diameter ends of the grips 60 and 70 face each other.

In use, the grips 40 and 50 are used for doing presses, and the grips 60 and 70 are used for doing curls. The grips may be placed along the bar as desired for the convenience of the user, to accommodate the user's hand size with respect to each grip and to locate the grip at the desired distance between the user's hands on the bar. This is best illustrated in FIGS. 5 and 6.

FIGS. 5 and 6 are front views illustrating portions of the apparatus of the present invention.

In FIG. 5, the grip 60 is shown with its small diameter end facing the weight 12, and its large diameter end facing inwardly, toward the center of the bar 10. A double headed arrow disposed above the grip 60 indicates that the grip 60 may be moved along the bar 10 according to the convenience of the user.

With the large diameter end on the "inside" of the bar or facing inwardly, and the small diameter end on the "outside" of the bar, or facing outwardly, the grip 60 is used for doing curl type exercise. The user grasps the grip 60 to hold the bar 10 on the particular diameter of the grip 60 that will appropriately compensate for the bone structure of a person's wrist so that the wrist and hand will be aligned with the ulna and radius bones of the arm. The grip 60 accordingly compensates for the bone structure of the wrist to allow the bones in the hand, the metacarpals and the phalanges, to remain substantially aligned parallel with the ulna and radius in the forearm.

In FIG. 6, the grip 40 is shown with its large diameter end adjacent to the weight 12. A solid double-headed arrow above the grip 40 indicates that the grip 40 may be moved longitudinally along the bar 10 so that it may be positioned appropriately for the user.

With the wide diameter end of the grip 40 outwardly, or adjacent to, or facing, the weight 12, the grip 40 is in the proper orientation for being used in conjunction with presses. Thus, when the grip 40 is used properly on the bar 10, the metacarpal and phalanges of a user's hand will remain aligned substantially parallel to the ulna and radius bones in the user's forearms.

In FIGS. 5 and 6, only a single hand grip is shown. Obviously, the grips will be paired with an oppositely disposed grip appropriate to the particular exercise, whether it be curling exercises (FIG. 5) or pressing exercises (FIG. 6) by the user.

Since the grip elements 40, 50, 60, and 70 with their respective covers 80, are substantially identical, it is obvious that only two such grips are required. The grips may simply be removed from one orientation and placed in another orientation when it is desired to do the various exercises. Thus the pair will be oriented in one way, as shown in FIG. 1 for the grips 40, 50, for doing presses, and they will be reversed, as shown for the grips 60 and 70 in FIG. 1, for curl exercises. If desired, the grips may be secured together at their narrow ends, to define a double set, as shown in FIG. 1. The double pair may then may simply be moved longitudinally on the bar as desired for the particular type of exercise being done, and according to the size of the user's hands and the desired width between hands when doing the various exercises.

Figure 9:
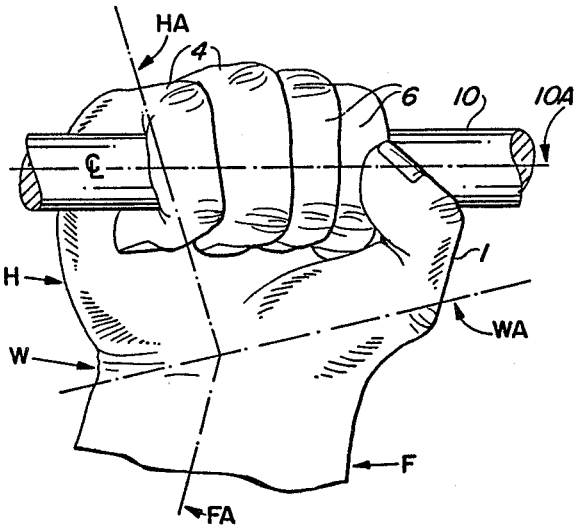
FIG. 9 (PRIOR ART)
FIG. 9 is a front view of a hand, and representing the prior art.

FIG. 9 is a front view of a hand H holding the weightlifting bar 10 for curl type weightlifting exercises. The hand H includes a thumb 1 and four fingers 2 which are wrapped around the bar 10. The hand H is connected to a wrist W, and the wrist W is in turn connected to a forearm F.

Figure 10:
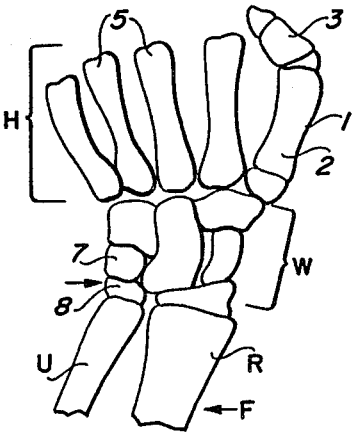
FIG. 10 is a front view of the bones of the hand, the wrist, and the forearm, as illustrated in FIG. 9.

FIG. 10 is a front view of some of the bones of the hand H, the wrist W, and the forearm F of FIG. 9, and without the bar 10. FIG. 10 illustrates the positions of the bones of the hand, wrist, and forearm, in the environment of FIG. 9. For the following discussion, reference will be made to both FIGS. 9 and 10.

In FIG. 9, four axes lines are illustrated by dashed lines. There is an axis 10A which represents the longitudinal axis of the bar 10. There is an axis HA which represents the axis of the hand, and axis WA which represents the axis of the wrist, and an axis FA which represents the axis of the forearm. It will be noted that the axis FA, or the axis of the forearm, is essentially vertical. The axis HA is substantially perpendicular to the axis 10A, meaning that the hand maintains a perpendicular orientation with respect to the axis of the bar 10 which it is gripping. However, the axis HA is not aligned with the axis FA. Moreover, the axis WA is not parallel with the axis 10A, indicating that the wrist is not maintained in a desired orientation. An explanation for the orientation of the hand, the wrist, and the forearm, is best illustrated in FIG. 10, which shows the bones of a portion of the hand, the wrist, and the forearm.

In FIG. 9, the hand H includes a thumb 1 and four fingers 4. In FIG. 10, some of the bones of the hand are illustrated. The hand H is shown with a thumb 1, or with two portions of the thumb 1, including a carpal bone 1 and phalanx bone 3. The hand also includes a plurality of metacarpal bones 5, with the phalanx or phalanges bones 6 illustrated only in FIG. 9.

The wrist W comprises the carpal bones, of which two are of particular significance. The carpal bones of significance include the triquetral bone 7 and the distal epiphysis of ulna 8. In the forearm, the radius bone is designated by reference R, and the ulna bone is designated by reference U.

It will be noted that the triquetral bone 7 and the distal epiphysis of ulna bone 8 are disposed against each other. However, in so doing, the carpal bones W of the wrist are canted downwardly, due to the canted angle of the hand under the force or weight of the bar 10. The axis of the bar 10A is illustrated in FIG. 10, as well as in FIG. 9, and the axis of the hand HA is similarly illustrated in both FIGS. 9 and 10. It will be noted that the axis of the hand HA generally remains perpendicular to the axis of the bar 10A.

In FIG. 9, the axis of the wrist 4A, or the axis of the carpal bones, is not perpendicular to the axis of the forearm FA.

Figure 11:
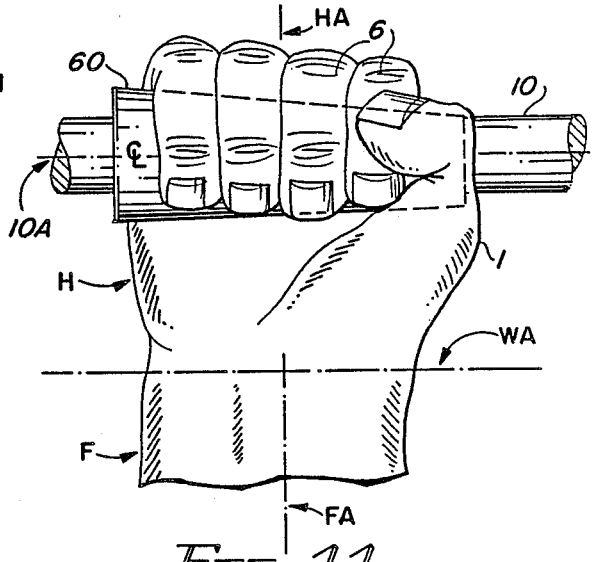
FIG. 11 is a front view of a hand utilizing the apparatus of the present invention.
Figure 12:
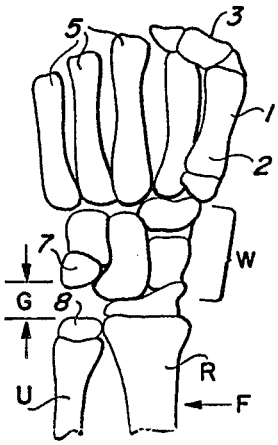
FIG. 12 is a front view of the bone structure of the hand, the wrist, and the forearm of FIG. 11.

FIG. 11 is a front view of the hand H, the wrist W, and the forearm F of FIG. 9 gripping the bar 10 with the tapered grip 60 disposed on the bar and grasped in the hand H. FIG. 12 is a view of some of the bones of the hand, illustrating the alignment of the bones in the hand when the apparatus 60 of the present invention is disposed on the bar 10. The axis of the hand HA is shown as substantially parallel and aligned with the axis of the forearm FA. The axis of the wrist WA is generally parallel to the axis of the bar 10A. With the alignment of the bones, and the axes as discussed, the spacing between the triquetral bone 7 and the distal epiphysis of ulna bone 8 is illustrated. The gap between the two bones, identified by reference G in FIG. 12, comprises the correct or normal orientation of the bones in the hand. There is, anatomically speaking, a space between the triquetral bone 7 and the distal epiphysis of ulna bone 8 in the normal hand. The truncated conical configuration of the grip apparatus 10 provides the extra spacing or distance for the hand H to allow the hand to compensate for the space G, thus allowing the hand to maintain its normal configuration. Obviously, as discussed above, this removes a substantial strain which otherwise exists on the hand, and particularly the wrist, as a weightlifter exercises.

In FIGS. 9 and 11, the hand H is grasping the bar 10 in a curl configuration. In the curl configuration, the wide end of the grip 60 extends toward the outer portion of the hand, away from the thumb 1. The wider distance at the outer end of the grip compensates for the gap G between the triquetral bone and the distal epiphysis of ulna bone.

Essentially, as is shown in FIGS. 11 and 12, the carpal and metacarpal bones are appropriately aligned with the ulna and the radius, and accordingly the phalanges bones, which are the extensions of the fingers, also maintain such alignment, since they are essentially a continuation of the metacarpal bones. The alignment of the bones in the hand and the wrist allows the weight to be aligned with the large radius bone, or, instead of cocked at an angle, as illustrated in FIGS. 9 and 10.

As will be understood from viewing FIGS. 10 and 12, the anatomical or bone structure of the hand essentially, for weightlifting purposes, has a missing bone in the wrist, between the triquetral bone and the distal epiphysis of ulna bone, which allows movement of the hand laterally. When weight is applied to the hand, as through a bar and weightlifting, the hand is pushed laterally and this causes a strain on the muscles and on the bones themselves. The relatively wide end of the tapered grip essentially provides a wedge at the corner of the hand which takes the place of the missing bone. This allows the hand to be aligned relatively straight with the arm, and specifically allows the hand to be aligned with the large radius bone.

To compensate for the "missing" bone, as shown in FIG. 10, the ulna bone, or the small bone at the outer side of the arm, tries to meet up with the bar and with the bones of the hand, and therefore the hand cocks at an angle. This is simply due to the bone structure of the human body. The grip 60, and the other grips discussed herein, essentially make up for the "missing" bone, to align the hand with the radius through solid or continuous bone elements. This, of course, takes the strain off the wrist muscles and off the bones of the wrist, or the carpal bones, which are not appropriately aligned.

It will be noted, particularly from FIG. 2, that the truncated conical grip element has a relatively smooth, continuously tapered exterior surface. If desired, depressions or grooves may extend downwardly or radially inwardly into the outer surface for accommodating particular fingers. Such grooves may be advantageous under certain circumstances for helping a user to maximize a grip on the bar. This is illustrated in FIG. 7. FIG. 7 comprises a side view of a portion of a tapered grip element 110. The tapered grip element 110 includes a tapered outer surface 112, with a plurality of spaced apart grooves 114 extending circumferentially about the element 110. The grooves 114 break the exterior surface 112 into a series of alternating smooth and concave elements of varying diameters. The diameter at any location varies in accordance with the overall taper of the grip element 110.

In the alternative to the continuous grooves of FIG. 7, the concave grooves or depressions may extend only part way around the grip element, instead of extending substantially continuously. This is shown in FIG. 8.

FIG. 8 comprises a view in partial section diametrically through a grip element 120. The grip element 120 includes a concave groove 122 which extends partially about the circumference of the tapered grip element 120. The grip element 120 also includes an interior bore 126 extending longitudinally of the grip element 120. A longitudinally extending slot 128 extends radially from the bore 126 to the outer circumference of the grip element 120.

In FIG. 7, the grooves 114 extend continuously circumferentially about the grip element 110. In FIG. 8, the concave grooves 122 extend only for a limited distance with respect to the circumference of the grip. The grooves 122 are circumferentially or arcuately extending, but do not extend completely about the circumference of the grip element 120.

Whether a user desires relatively smooth, continuous grip elements, as shown in FIGS. 1–6, or the grip elements as shown in FIGS. 7 and 8, depends on the preference of the individual involved. Covers for the grip elements of FIGS. 7 and 8 will, obviously, be more complicated than the cover 80 for the smooth grip elements illustrated in FIGS. 1–6. However, the covers for the grip elements 110 and 120 still are preferably made of a non-skid material, such as leather.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Grip apparatus for curl and for press type weightlifting exercises to align the bones in the hand and wrist of a user generally parallel to the bones in the user's forearm, comprising, in combination:

bar means, including a bar having outer ends and weights secured at the outer ends;

grip means movable on the bar between the weights, including a tapered conical element extending longitudinally on the bar and having a varying diameter over its length and along the width of a user's hand, with the greatest diameter at the outside of the hand, to compensate for the bone structure at the outside portion of a user's wrist, to provide that the metacarpal and phalanx bones are aligned substantially parallel to the ulna and radius bones in the user's forearm, and that the carpal bones are in their normal orientation as the user performs curl and press type exercises with the bar; and a bore extending longitudinally in the tapered conical element for receiving the bar.

2. The apparatus of claim 1 in which the grip means include a cover for the tapered conical element.

3. The apparatus of claim 2 in which the cover is made of non-slip material to prevent the user's hands from slipping.

4. The apparatus of claim 3 in which the cover is secured to the tapered conical element to prevent relative movement between them as a user uses the apparatus.

5. The apparatus of claim 1 in which the grip means includes a plurality of circumferentially extending grooves for receiving a user's fingers.

6. The apparatus of claim 5 in which the grooves extend arcuately for a distance less than the circumference of the tapered conical element.

7. The apparatus of claim 5 in which the grooves extend arcuately for a distance equal to the circumference of the tapered conical element.

8. The apparatus of claim 1 in which the grip means includes a first element having a portion of minimum diameter and first portion of increasing diameter in a first direction away from the minimum diameter portion for curl type weightlifting exercises and a second portion of increasing diameter in a second direction away from the minimum diameter portion for press type weightlifting exercises.

9. Weightlifting apparatus for curl and for press type weightlifting exercises, comprising, in combination:

bar means, including a bar having outer ends and weights at the outer ends for use in curl and press type weightlifting exercises; and grip means on the bar means for allowing a user to grip the bar means during weightlifting exercises, including a first grip for one hand and a second grip for another hand, and each grip includes a tapered element tapering from a minimum diameter to a maximum diameter, with the taper corresponding to a user's hand from the minimum diameter at the inside of the hand to the maximum diameter at the outside of the hand.

10. The apparatus of claim 9 in which the grip means includes a cover for the tapered element.

11. The apparatus of claim 9 in which the grip means is movable on the bar means for adjusting the location of the tapered element by the user.

12. The apparatus of claim 9 in which the tapered element of the grip means includes a first taper from the minimum diameter and a second taper from the minimum diameter for using the first taper for press type exercises and the second taper for curl type exercises.

13. The apparatus of claim 9 in which the grip means includes a first tapered element having a first taper and a second taper and a second tapered element having a first taper and a second taper, and one hand of the user uses the first tapered element and another hand of the user uses the second tapered element for weightlifting exercises.

14. The apparatus of claim 13 in which the first taper of each tapered element is for use in press type weightlifting exercises and the second taper of each tapered element is for curl type weightlifting exercises.

15. The apparatus of claim 9 in which the bar means includes a bar having outer ends, and weights are secured to the outer ends, and the grip means is disposed on the bar between the weights.

16. The apparatus of claim 15 in which the grip means is movable on the bar.

17. Weightlifting apparatus for curl and press type weightlifting exercises, comprising, in combination:

bar means for use in curl and press type weightlifting exercises; and grip means on the bar means for allowing a user to grip the bar means during weightlifting exercises, including a pair of grips, comprising a first grip for a user's one hand and a second grip for a user's second hand, and each grip is tapered to provide a minimum diameter at the hand adjacent to the user's thumb and a greater diameter adjacent to the outer portion of the user's hand to compensate for the bone structure of the user's wrist to allow for the alignment of the bones in the user's hands with the bones in the user's forearm.

18. The apparatus of claim 17 in which the grip means includes groove means for receiving the user's fingers.

* * * * *